US010873131B2

(12) United States Patent
Cheng

(10) Patent No.: US 10,873,131 B2
(45) Date of Patent: Dec. 22, 2020

(54) RADIO FREQUENCY MATCHING DEVICE OF TIRE PRESSURE SENSOR

(71) Applicant: SYSGRATION LTD., Taipei (TW)

(72) Inventor: Chia-Wen Cheng, Taipei (TW)

(73) Assignee: SYSGRATION LTD., Taipei (TW)

( * ) Notice: Subject to any disclaimer, the term of this patent is extended or adjusted under 35 U.S.C. 154(b) by 0 days.

(21) Appl. No.: 16/711,428

(22) Filed: Dec. 12, 2019

(65) Prior Publication Data

US 2020/0203829 A1 Jun. 25, 2020

(30) Foreign Application Priority Data

Dec. 19, 2018 (TW) ..... 107145832 A

(51) Int. Cl.
*H01Q 5/335* (2015.01)
*G08C 17/02* (2006.01)
*H01Q 1/22* (2006.01)

(52) U.S. Cl.
CPC ..... *H01Q 5/335* (2015.01); *G08C 17/02* (2013.01); *H01Q 1/2241* (2013.01)

(58) Field of Classification Search
CPC ..... H01Q 5/335; H01Q 1/2241; G08C 17/02
See application file for complete search history.

(56) References Cited

U.S. PATENT DOCUMENTS 9,333,815 B2 5/2016 Henriet et al.
2012/0235847 A1* 9/2012 Viikari ..... G01S 13/75 342/5
2014/0306815 A1* 10/2014 Henriet ..... B60C 23/0471 340/447

FOREIGN PATENT DOCUMENTS

CN 102326330 A 1/2012
CN 106341142 A 1/2017
TW M549458 U 9/2017
TW I625043 9/2018

* cited by examiner

*Primary Examiner* — Amine Benlagsir

(57) ABSTRACT

The invention discloses a radio frequency (RF) matching device for a tire pressure sensor, which includes a system control unit, a RF control unit, a RF matching unit, and a multi-frequency antenna in order, wherein the RF matching unit includes a resonance portion, a filtering portion, and a matching portion in order, wherein the resonance unit is connected to the RF control unit to be adjusted to the required initial frequency and cut-off frequency of various frequency bands; the filter unit is connected between the resonance unit and the matching unit to suppress and eliminate noise and unwanted frequency-doubling signals; the matching unit allows the maximum power of the multi-frequency RF signal to be transferred to the multi-frequency antenna, so that the multi-frequency antenna can transmit multiple RF signals of different frequencies.

5 Claims, 10 Drawing Sheets

| Peak Table | | |
|---|---|---|
| | Frequency (GHz) | dBm |
| 1 | 0.3151 | 5.77 |
| 2 | 0.6300 | -19.88 |
| 3 | 0.9450 | 21.33 |
| 4 | 0.3411 | -40.27 |
| 5 | 0.4711 | -49.04 |
| 6 | 0.4451 | -50.15 |
| 7 | 0.6261 | -54.17 |

Peak Table

| | Frequency (GHz) | dBm |
|---|---|---|
| 1 | 0.3151 | 5.77 |
| 2 | 0.6300 | -19.88 |
| 3 | 0.9450 | -21.33 |
| 4 | 0.3411 | -40.27 |
| 5 | 0.4711 | -49.04 |
| 6 | 0.4451 | -50.15 |
| 7 | 0.6261 | -54.17 |

Peak Table

| | Frequency (GHz) | dBm |
|---|---|---|
| 1 | 0.4341 | 7.51 |
| 2 | 0.8680 | -27.67 |
| 3 | 0.4081 | -41.33 |
| 4 | 0.4591 | -42.05 |
| 5 | 0.3821 | -46.16 |
| 6 | 0.4861 | -48.04 |
| 7 | 0.3041 | -50.30 |
| 8 | 0.3301 | -50.55 |
| 9 | 0.5380 | -52.35 |
| 10 | 0.2781 | -52.52 |
| 11 | 0.0261 | -52.53 |
| 12 | 0.5900 | -54.73 |

| Peak Table | | |
|---|---|---|
| | Frequency (GHz) | dBm |
| 1 | 0.3151 | 4.78 |
| 2 | 0.3411 | -40.65 |
| 3 | 0.6300 | -49.85 |
| 4 | 0.4711 | -50.84 |
| 5 | 0.4451 | -51.14 |
| 6 | 0.0261 | -54.36 |

Peak Table

| | Frequency (GHz) | dBm |
|---|---|---|
| 1 | 0.4341 | 6.38 |
| 2 | 0.4081 | -41.40 |
| 3 | 0.4611 | -42.27 |
| 4 | 0.3821 | -46.22 |
| 5 | 0.4861 | -49.57 |
| 6 | 0.3301 | -50.88 |
| 7 | 0.3041 | -51.95 |
| 8 | 0.0261 | -52.15 |
| 9 | 0.5380 | -55.17 |
| 10 | 0.0511 | -56.07 |

Peak Table

| | Frequency (GHz) | dBm |
|---|---|---|
| 1 | 315.1 | -9.99 |
| 2 | | |
| 3 | | |
| 4 | | |
| 5 | | |
| 6 | | |

Peak Table

| | Frequency (GHz) | dBm |
|---|---|---|
| 1 | 433.9 | -10.62 |
| 2 | 407.8 | -58.01 |
| 3 | 381.7 | -58.36 |
| 4 | | |
| 5 | | |
| 6 | | |

RADIO FREQUENCY MATCHING DEVICE OF TIRE PRESSURE SENSOR

BACKGROUND OF THE INVENTION

Field of the Invention

The present invention relates to a radio frequency matching device, and more particularly, to a radio frequency matching device disposed in a tire pressure sensor and capable of matching a matching circuit required for a multi-frequency radio frequency antenna without using any switching circuit.

Description of the Prior Art

In general, a tire pressure detection system mainly comprises two parts: a monitoring host installed in the vehicle and a tire pressure sensor installed in the tire. The monitoring host and the tire pressure sensor use common radio frequency to transmit wireless signals, which is usually 315 MHz or 433.92 MHz. Therefore, in order to provide the tire pressure sensors suitable for monitoring hosts at different frequencies, or allowing the monitoring host to receive signals from tire pressure sensors of different frequencies, it is common for the industry to sell a single frequency tire pressure sensor with the same frequency monitoring host according to the open frequency band of the country or region of sale, however, this causes difficulties in sales estimation and inventory management.

Based on the above reasons, some companies have proposed different improvements and applied for patents in response to this problem. For example, the U.S. Pat. No. 9,333,815 titled "multi-frequency tire pressure monitor" filed by Schrader Electronics Ltd uses a switching circuit to switch between two matching circuits with different frequencies, and then transmits the signal through the same antenna. However, there is still room for improvement in the design of the two matching circuits, such as the Taiwan Patent 1625043 titled "Antenna matching device for dual-frequency tire pressure sensor" filed by CUB ELECPARTS INC, in which a diode is coupled to a matching unit and the working state of the diode is controlled by a micro-controller unit to switch the impedance of the matching circuit.

However, the above-mentioned Taiwan patent or U.S patent still needs a switching means to adjust the impedance of the matching circuit, and then transmit a signal from the antenna. In this way, the matching circuit still needs to switch between impedances for different frequencies, which will increase the power consumption of the tire pressure sensor, reduce circuit operation efficiency and cause higher cost; therefore, it is necessary to propose a new matching device to improve this problem.

SUMMARY OF THE INVENTION

In view of the problems of the prior art, it is an object of the present invention to provide a radio frequency (RF) matching device for a tire pressure sensor, which can match multi-frequency signals to achieve the purpose of reducing power consumption and cost without using a switching circuit.

According to an object of the present invention, a radio frequency (RF) matching device is provided for a tire pressure sensor, which comprises a system control unit, a RF control unit, a RF matching unit, and a multi-frequency antenna in order, wherein the system control unit is connected to the RF control unit 2 and is used for determining which one of a plurality of different frequency signals is to be emitted by the RF control unit, and the matching unit is connected between the RF control unit and the multi-frequency antenna 4. The RF matching unit comprises a resonance portion, a filtering portion, and a matching portion, wherein the resonance unit is connected to the RF control unit to be adjusted to the required initial frequency and cut-off frequency of various frequency bands; the filter unit is connected between the resonance unit and the matching unit to suppress and eliminate noise and unwanted frequency-doubling signals; the matching unit allows the maximum power of the multi-frequency RF signal to be transferred to the multi-frequency antenna, so that the multi-frequency antenna can transmit multiple RF signals of different frequencies.

The resonance portion comprises a plurality of passive elements, each one of the plurality of passive elements is connected in series or in parallel to one another to adjust the initial frequency and the cutoff frequency of the various frequency bands required for RF frequency matching.

The filtering portion is a filter which can be a low-pass filter, a band-pass filter, or a band-stop filter to suppress noise and unwanted frequency-doubling signals.

The RF matching unit comprises a plurality of passive elements, and each one of the passive elements is connected in series or parallel to one another, and can be matched with each frequency signal emitted by the RF control unit.

According to the above, the present invention has one or more of the following features:

1. The present invention does not require using any switching elements to improve the overall circuit operation efficiency and reduce the occupied circuit space.
2. The multi-frequency antenna uses only the resonance portion 30 to obtain the resonance point of the required frequency band so as to match RF signals transmitting different frequencies.
3. The present invention does not require using any switching element, thereby saving component costs, reducing power consumption effectively, and improving the battery life of a tire pressure sensor.

DETAILED DESCRIPTION OF THE INVENTION

Figure 1:
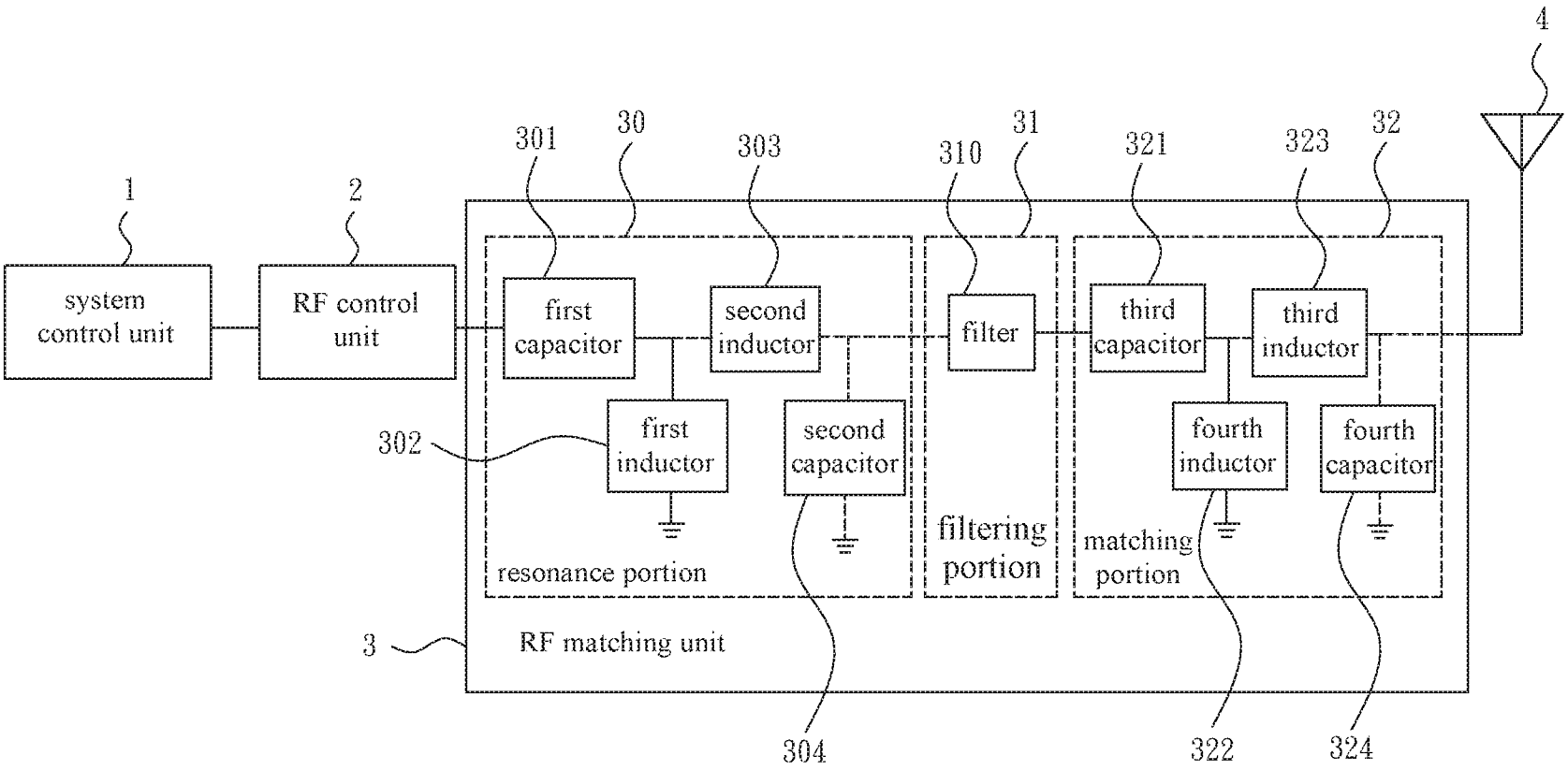
FIG. 1 illustrates a schematic diagram of the architecture of the present invention.

Referring to FIG. 1, the present invention disclosed a radio frequency (RF) matching device for a tire pressure sensor, which comprises a system control unit 1, a RF control unit 2, a RF matching unit 3, and a multi-frequency antenna 4, wherein the system control unit 1 is connected to the RF control unit 2 and is used for determining which one of a plurality of different frequency signals is to be emitted by the RF control unit 2, and the matching unit 3 is connected between the RF control unit 2 and the multi-frequency antenna 4.

In the present invention, the RF matching unit 3 comprises a resonance portion 30, a filtering portion 31, and a matching portion 32, wherein the resonance portion 30 is connected to the RF control unit 2, to be adjusted to the initial frequency and cut-off frequency of the various required frequency bands. The filtering portion 31 is connected between the resonance portion 30 and the matching portion 32 to suppress and eliminate noise and unwanted frequency-doubling signals of different frequency signals, and the matching portion 32 allows the maximum power of the RF signal energy (signal power) to be transferred to the multi-frequency antenna 4 so that the multi-frequency antenna 4 can transmit multiple RF signals of different frequencies.

Figure 2:
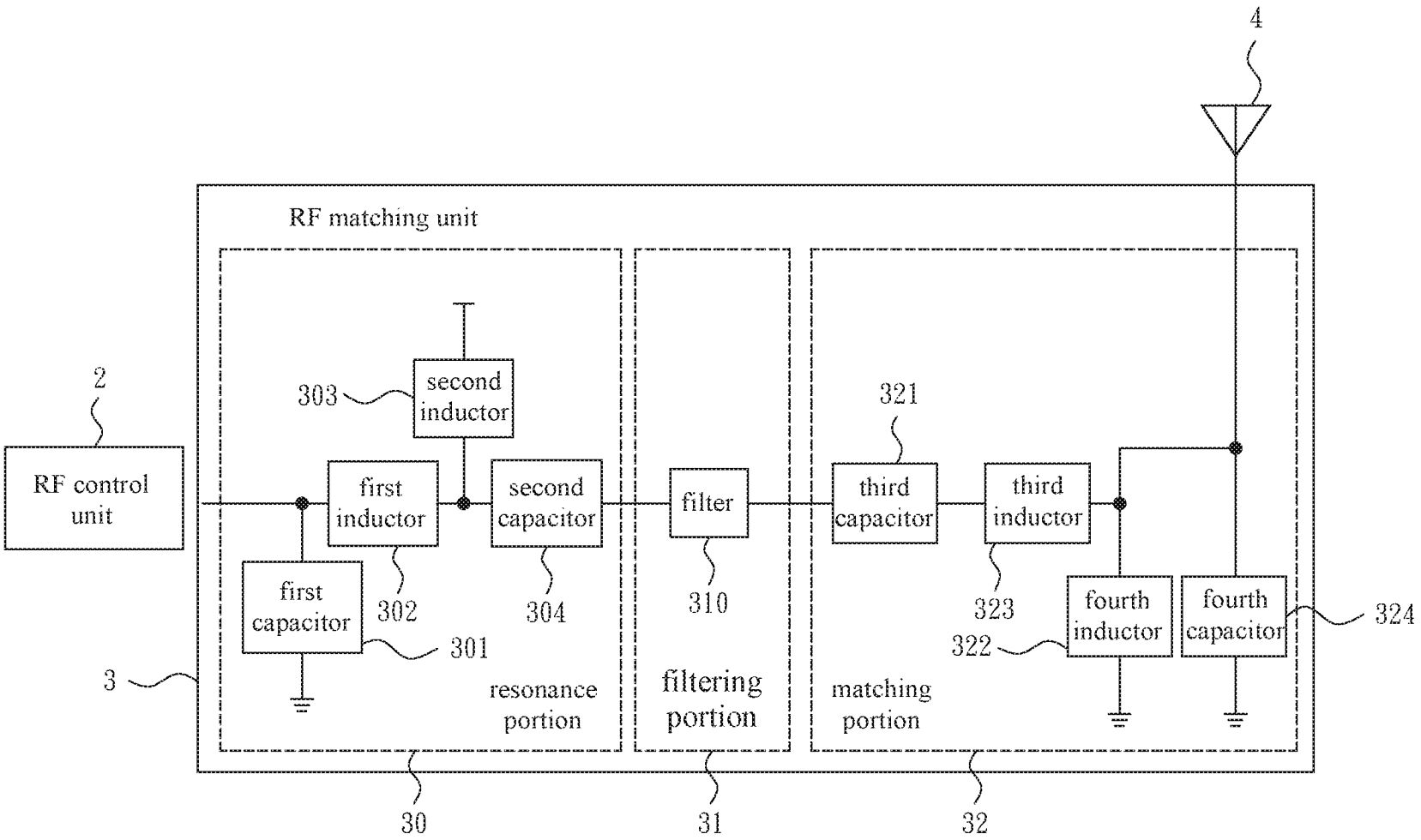
FIG. 2 illustrates a schematic diagram of an embodiment of a RF matching unit of the present invention.

Referring to FIG. 2, in the present invention, the resonance portion 30 comprises a plurality of passive elements (301 to 304), and each passive element is connected in series or parallel to one another to adjust the initial frequency and the cut-off frequency of the required multiple frequency bands. The filtering portion 31 is a filter, particularly a low-pass filter, a band-pass filter, or a band-stop filter, so that the frequency-doubling signals of required multiplied frequency band signals are cut off. The matching portion 32 comprises a plurality of passive elements (321 to 324), and each passive element is connected in series or parallel to one another and can be matched with each frequency signal emitted by the RF control unit.

In order to further understand the present invention, please refer to the embodiment shown in FIG. 2 and explained as follows:

In this embodiment, the resonance portion 30 comprises a first capacitor 301, a first inductor 302, a second inductor 303, and a second capacitor 304, and the matching portion 32 comprises a third capacitor 321, a third inductor 323, a fourth inductor 322, and a fourth capacitor 324, wherein one end of the first capacitor 301 is grounded, and one end of the first inductor 302 is connected to the RF control unit 2, the other end of the first capacitor 301 is connected between the first inductor 302 and the RF control unit 2, and the other end of the first inductor 302 is connected to one end of the second capacitor 304. One end of the second inductor 303 is connected to a power supply, and the other end is connected between the first inductor 302 and the second capacitor 304, the other end of the second capacitor 304 is connected to one end of the filter 310, and the other end of filter 310 is connected to the third capacitor 321, the other end of the third capacitor 321 is connected to one end of third inductor 323, the other end of third inductor 323 is connected to one end of fourth inductor 322 and one end of fourth capacitor 324, the other end of the fourth inductor 322 and the other end of the fourth capacitor 324 are both grounded, and one end of the fourth capacitor 324 is also connected to the antenna unit 4.

The third capacitor 321, the third inductor 323, the fourth inductor 322, and the fourth capacitor 324 are adjusted one by one to achieve proper placement and proper element values according to the actual design of the device case and the PCB board, wiring, impedance, and component configuration, allowing the matching portion 32 to be matched with the first frequency (315 MHz) and the second frequency (433.92 MHz) at the same time, and to be connected in series with the filter 310. In addition, the above different types of resistors, capacitors or inductors connected in series or parallel can be adjusted to achieve proper placement and proper element values to obtain one or more resonance points in the required frequency band. The resonance points can be found in parameters provided by the network analyzer S11. It can be seen from the parameters that this allows the multi-frequency antenna to transmit RF signals of multiple frequencies.

Figure 3:
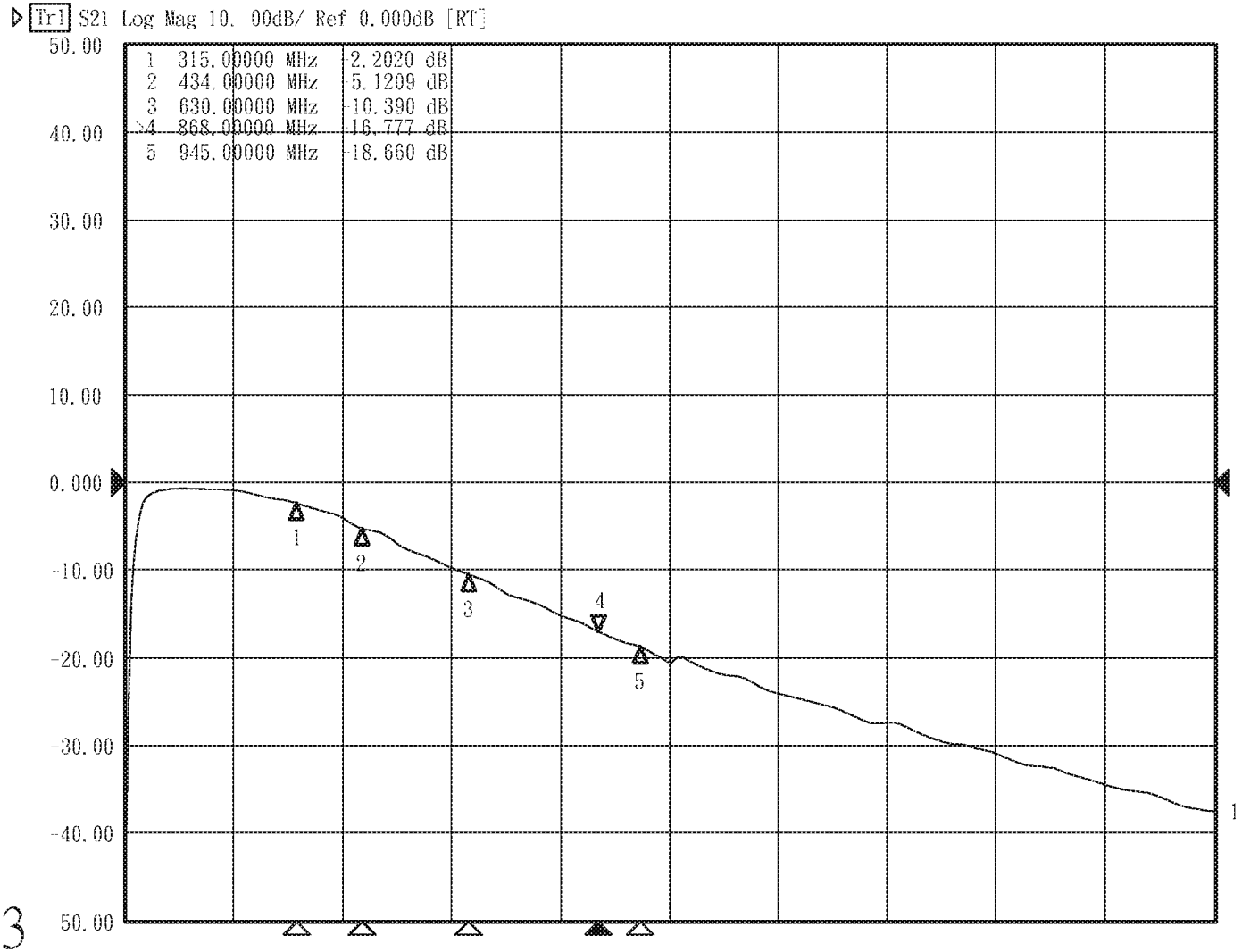
FIG. 3 illustrates a signal analysis diagram of a resonance portion of the embodiment of FIG. 2.
Figure 4:
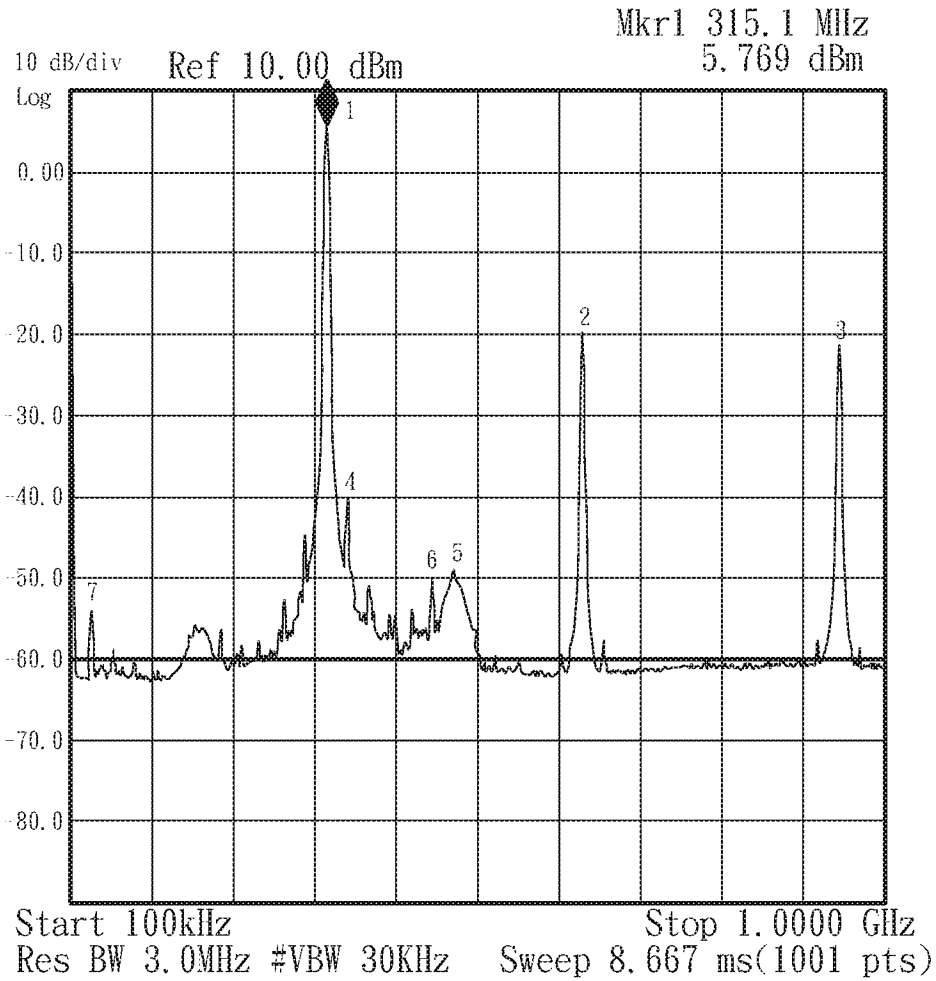
FIG. 4 illustrates a schematic diagram of analyzing the frequency-doubling signal of the first frequency of the resonance portion of the embodiment of FIG. 2.
Figure 5:
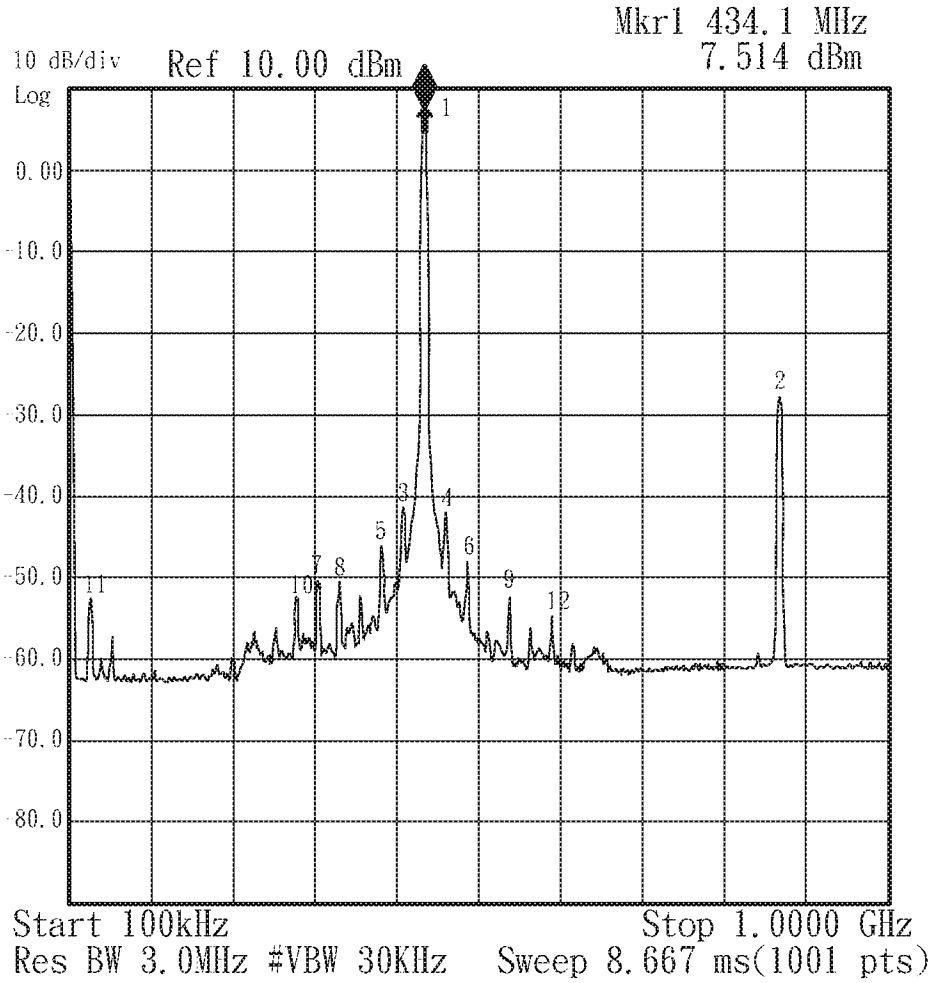
FIG. 5 illustrates a schematic diagram of analyzing the frequency-doubling signal of the second frequency of the resonance portion of the embodiment of FIG. 2.
Figure 6:
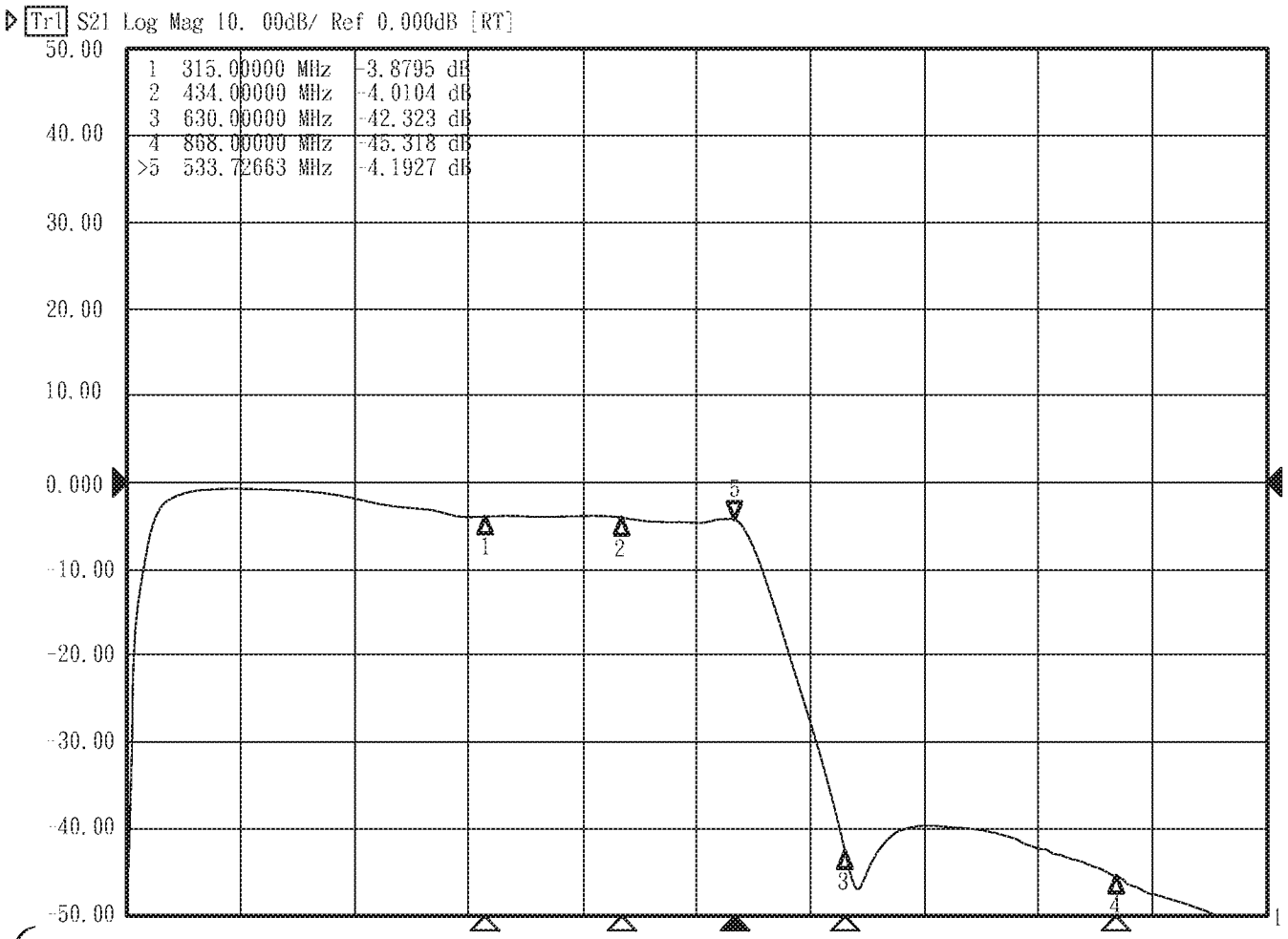
FIG. 6 illustrates a signal analysis diagram of the resonance portion and the filtering portion of the embodiment of FIG. 2.
Figure 7:
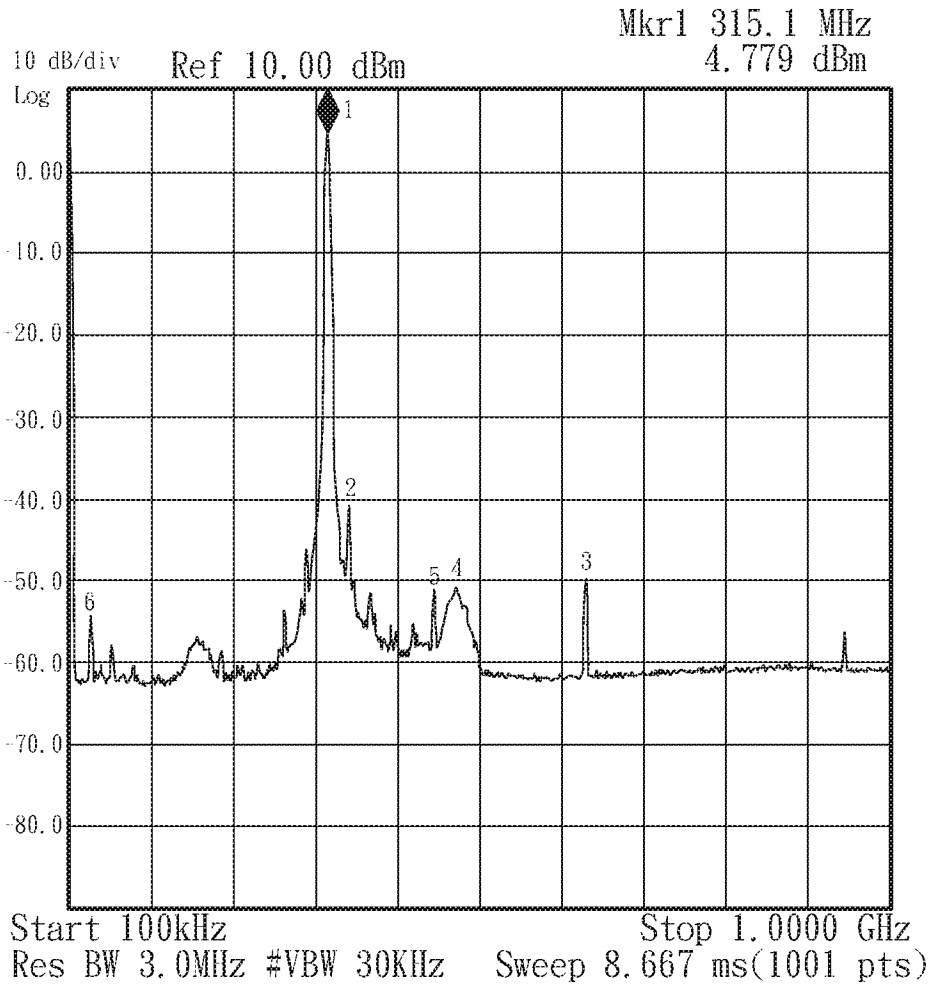
FIG. 7 illustrates another signal analysis diagram of the resonance portion and the filtering portion of the embodiment of FIG. 2.
Figure 8:
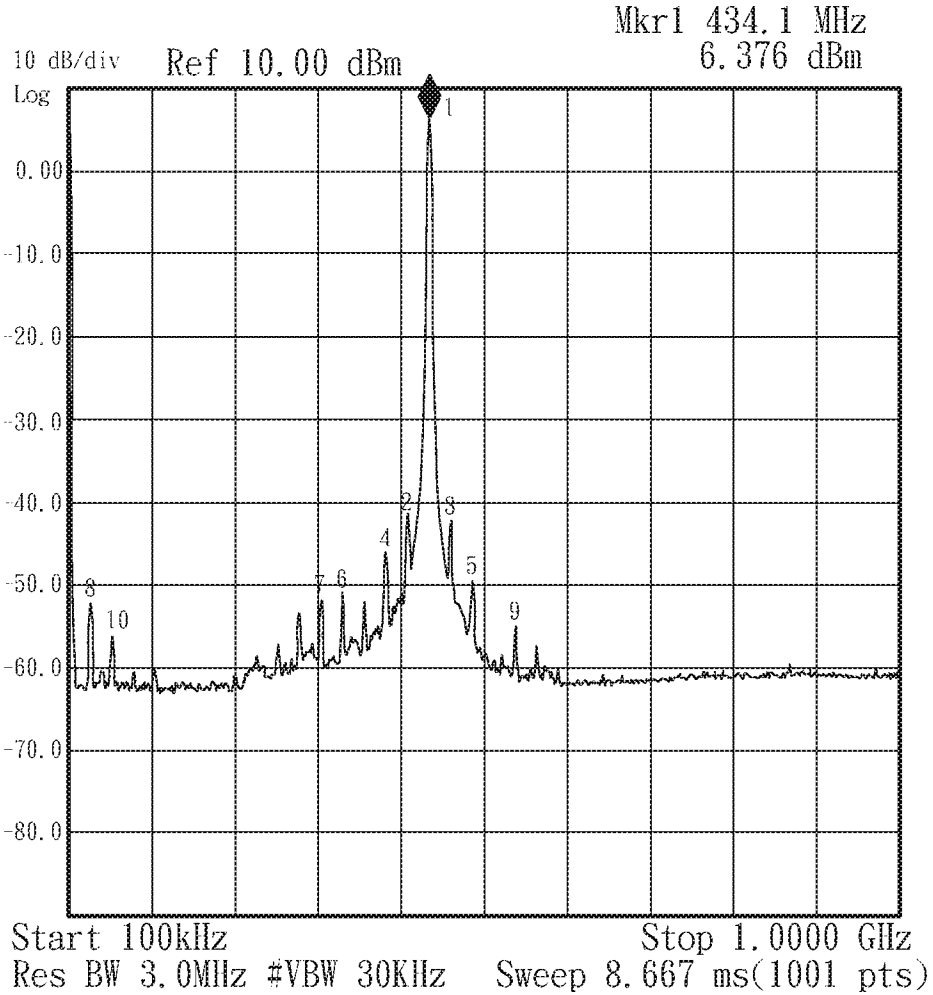
FIG. 8 illustrates another signal analysis diagram of the resonance portion and the filtering portion of the embodiment of FIG. 2.
Figure 9:
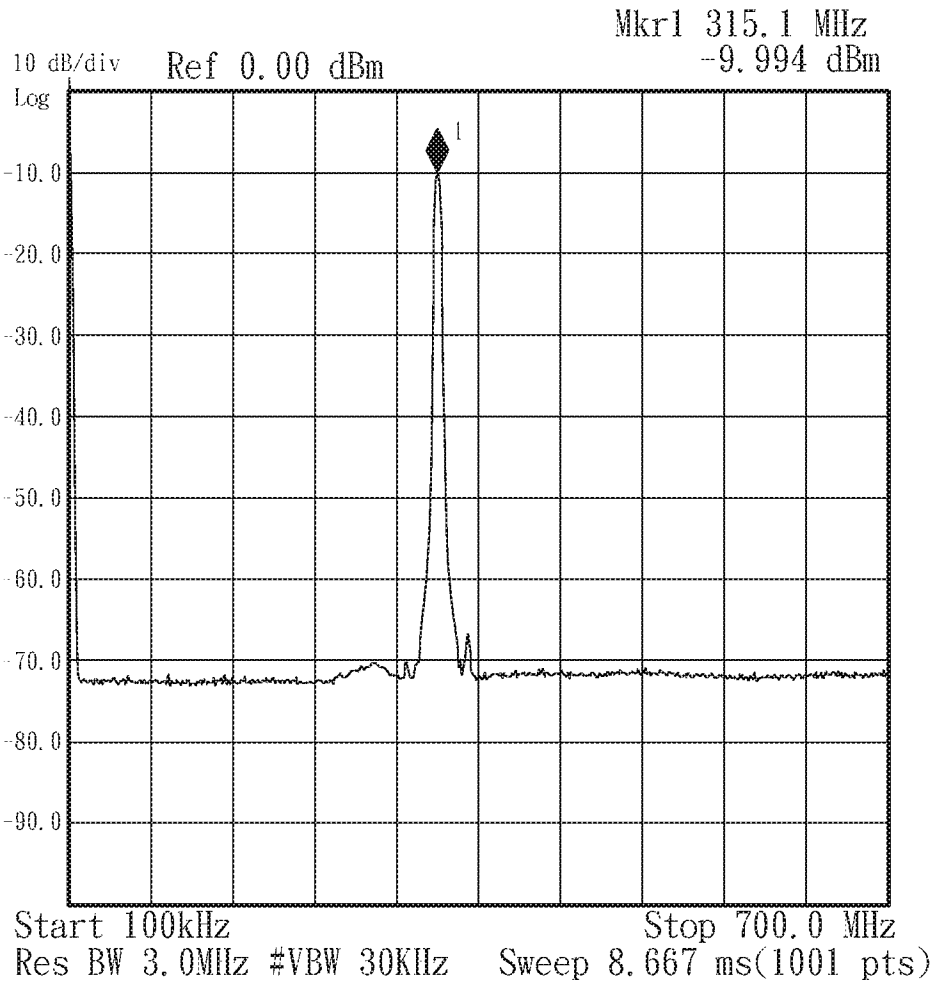
FIG. 9 illustrates another signal analysis diagram of the resonance portion and the filtering portion of the embodiment of FIG. 2.
Figure 10:
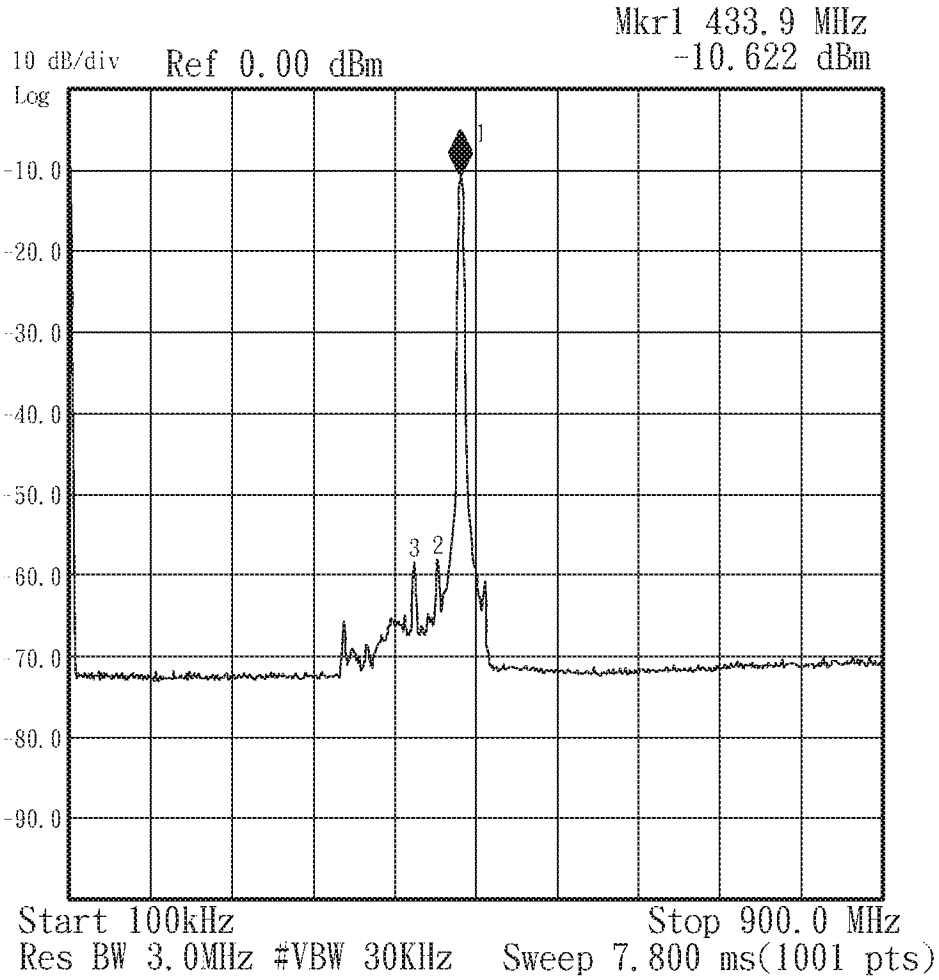
FIG. 10 illustrates another signal analysis diagram of the resonance portion and the filtering portion of the embodiment of FIG. 2.

Referring to FIG. 3, the system control unit 1 determines which one of the first frequency and the second frequency is to be emitted by the RF control unit 2. FIG. 3 shows that the bandwidth between 0~−20 dBm is 300 MHz~1 GHz before passing through the filtering portion 31. Referring to FIG. 4, the first frequency can be successfully transmitted, but the signal strength of the frequency-doubling and frequency-tripling signals of the first frequency signal is still too strong. Refer to FIG. 5, the second frequency can be successfully transmitted, but the signal strength of the frequency-doubling signal of the second frequency signal is still too strong. For normal operation and to avoid affecting the operation of other devices, as shown in FIG. 6, after filtering and suppression by the filter 310, the bandwidth between 0 and −20 dBm is 300 MHz to 550 MHz, and the frequency-doubling and frequency-tripling signals of the first frequency signal have been effectively suppressed (as shown in FIG. 7), furthermore, the frequency-doubling signal of the second frequency signal is also effectively suppressed (as shown in FIG. 8). Finally, referring to FIG. 9 and FIG. 10, after passing through the matching portion 32, it can be seen that both the first frequency and the second frequency signals can be effectively transmitted with little noise and interference of the frequency-doubling or tripling signals.

According to the above, the present invention does not require using any switching elements to improve the overall circuit operation efficiency and reduce the occupied circuit space. The multi-frequency antenna uses only the resonance portion 30 to obtain the resonance point of the required frequency band so as to match RF signals transmitting different frequencies. Furthermore, the present invention does not require using any switching element, thereby saving component costs, reducing power consumption effectively, and improving the battery life of a tire pressure sensor.

REFERENCE NUMERALS

1: system control unit
2: RF control unit
3: RF matching unit
4: multi-frequency antenna
30: resonance portion
301: first capacitor

302: first inductor
303: second inductor
304: second capacitor
31: filtering portion
310: filter
32: matching portion
321: third capacitor
322: fourth inductor
323: third inductor
324: fourth capacitor

What is claimed is:

1. A radio frequency (RF) matching device for a tire pressure sensor, comprising:

a RF control unit;

a multi-frequency antenna;

a system control unit connected to the RF control unit, wherein the system control unit determines one of a plurality of different frequency signals to be emitted by the RF control unit;

a RF matching unit connected between the RF control unit and the multi-frequency antenna without using a switching circuit, comprising:

a resonance portion connected to the RF control unit and adjusted to a frequency bandwidth between an initial frequency and a cutoff frequency for various required frequency bands;

a filtering portion connected to the resonance portion and provided for suppressing noise and frequency-doubling signals; and a matching portion connected to the filtering portion, a RF signal output by the filtering portion is output from the multi-frequency antenna at a maximum power.

2. The RF matching device of the tire pressure sensor as claimed in claim 1, wherein the resonance portion comprises a plurality of passive elements, each one of the plurality of passive elements is connected in series or in parallel to one another to adjust the initial frequency and the cutoff frequency of the various frequency bands required for RF frequency matching.

3. The RF matching device of the tire pressure sensor as claimed in claim 1, wherein the filtering portion is a filter.

4. The RF matching device of the tire pressure sensor as claimed in claim 3, wherein the filter is a low-pass filter, a band-pass filter, or a band-stop filter.

5. The RF matching device of the tire pressure sensor as claimed in claim 1, wherein the RF matching unit comprises a plurality of passive elements, and each one of the plurality of passive elements is connected in series or parallel to one another, and can be matched with each frequency signal emitted by the RF control unit.

* * * * *